US007993068B2

(12) United States Patent
Vincent

(10) Patent No.: US 7,993,068 B2
(45) Date of Patent: Aug. 9, 2011

(54) ARTICULATION-LOADABLE WRITING INSTRUMENT

(75) Inventor: André Vincent, Auxerre (FR)

(73) Assignee: Societe BIC, Clichy, Cedex (FR)

( * ) Notice: Subject to any disclaimer, the term of this patent is extended or adjusted under 35 U.S.C. 154(b) by 1066 days.

(21) Appl. No.: 11/813,485

(22) PCT Filed: Dec. 21, 2005

(86) PCT No.: PCT/FR2005/003235

§ 371 (c)(1),
(2), (4) Date: Jul. 6, 2007

(87) PCT Pub. No.: WO2006/075064

PCT Pub. Date: Jul. 20, 2006

(65) Prior Publication Data

US 2008/0138141 A1 Jun. 12, 2008

(30) Foreign Application Priority Data

Jan. 7, 2005 (FR) ..... 05 00182

(51) Int. Cl.
*B43K 5/16* (2006.01)

(52) U.S. Cl. ..... 401/257; 401/251

(58) Field of Classification Search ..... 401/131, 401/6, 73, 221, 247, 251, 257
See application file for complete search history.

(56) References Cited

U.S. PATENT DOCUMENTS 2,919,677 A 1/1960 Mansheim
4,149,812 A * 4/1979 Huffman, Jr. ..... 401/6
4,243,337 A 1/1981 Hocq et al.

FOREIGN PATENT DOCUMENTS

EP 0 299 804 1/1989

OTHER PUBLICATIONS

International Search Report for International Application No. PCT/FR2005/003235 mailed Jun. 21, 2006, French language version.
International Search Report for International Application No. PCT/FR2005/003235 mailed Jun. 21, 2006, English language translation of the French language version.

* cited by examiner

*Primary Examiner* — David J Walczak
(74) *Attorney, Agent, or Firm* — Jones Day

(57) ABSTRACT

A writing instrument comprising: a main body having a first end, a second end and a longitudinal axis extending in a longitudinal direction through the first and second ends; a writing tip disposed at the first end of the main body; an ink-containing cartridge; a rear body comprising an elongate housing having a first end a second end and an access opening at the first end allowing the ink-containing cartridge to be inserted into or removed from the housing, the housing extending in a loading direction between the first and second ends of the elongate housing; and an articulation means connecting the main body and the rear body. The articulation means allows the rear body to pivot with respect to the main body about an axis of articulation perpendicular to the longitudinal axis, between a loading or open position in which the access opening is rotated away from the longitudinal axis of the main body and a closed position in which the longitudinal direction and the loading direction substantially coincide.

19 Claims, 5 Drawing Sheets

FIG. 8
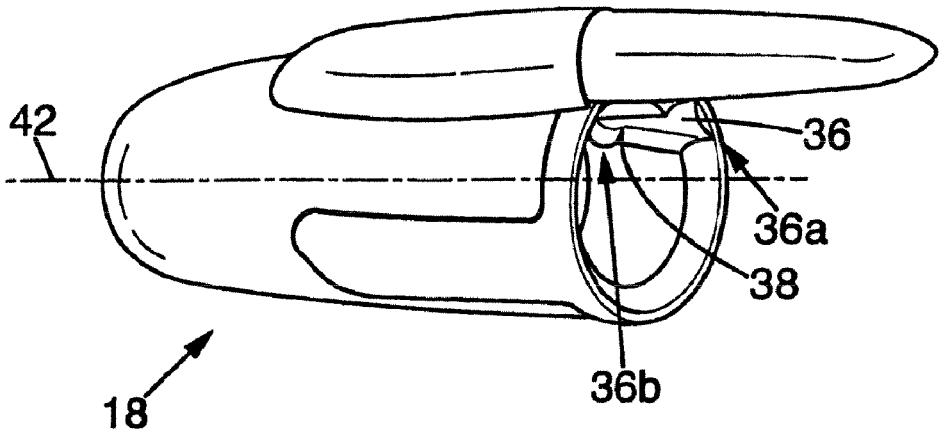
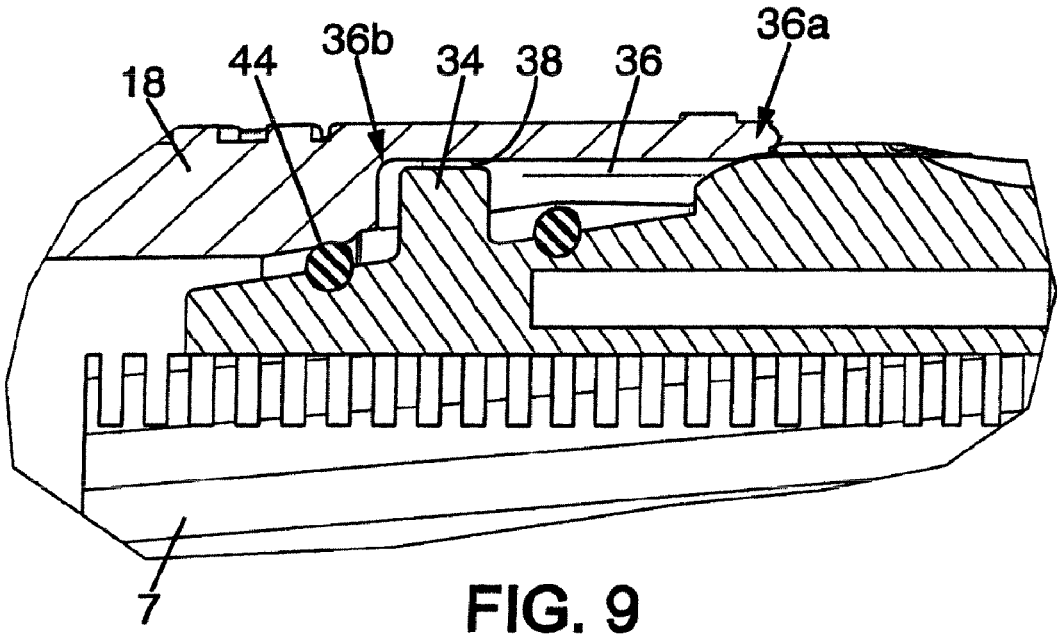
FIG. 9

FIG. 11
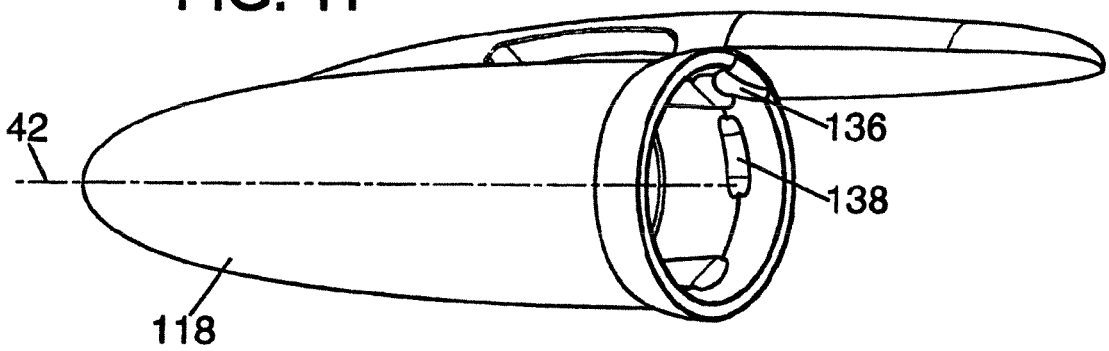
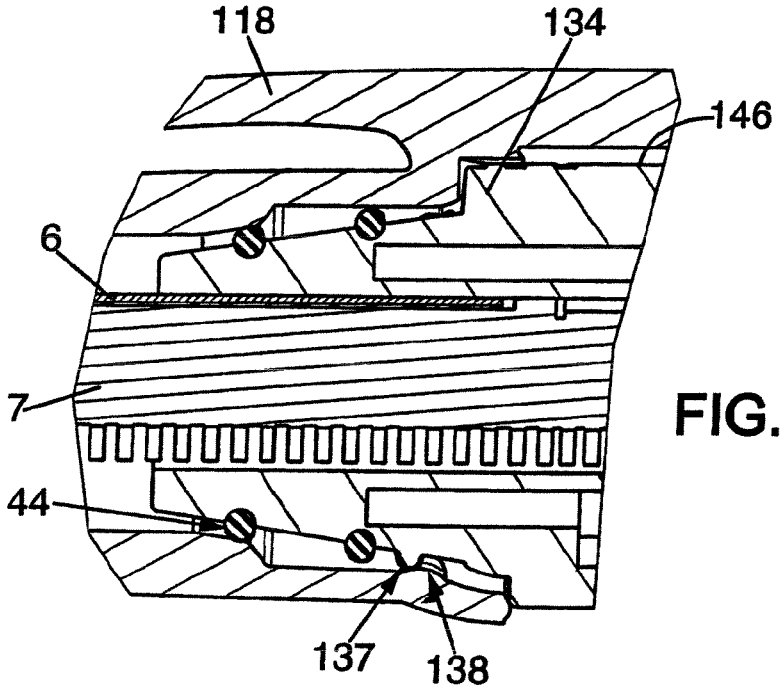
FIG. 12

ARTICULATION-LOADABLE WRITING INSTRUMENT

CROSS-REFERENCE TO RELATED APPLICATIONS

This application is a national stage application of PCT/FR2005/003235, filed on Dec. 21, 2005, which claims the benefit of priority from French Patent Application No. 0500182 filed on Jan. 7, 2005, the entire contents of both of which are incorporated herein by reference.

BACKGROUND OF THE INVENTION

1. Field of the Invention

Embodiments of the present invention relate to a writing instrument that employs a removable ink cartridge and, more specifically, relate to the means for loading and unloading the cartridge into and out of the writing instrument.

2. Description of the Related Art

Writing instruments comprising a main body running in a longitudinal direction between a first end and a second end, a writing tip being positioned substantially at the first end, a cartridge containing ink, and a rear loading body having an elongate housing running in a loading direction between a first end and a second end, the housing accepting the cartridge and having, at the first end, an access opening to allow the cartridge to be inserted into the housing or extracted, in the customary manner, are known.

SUMMARY OF THE INVENTION

The present invention is aimed at making it easier to unload the spent cartridge and load a new cartridge.

To do this, according to embodiments of the present invention, the writing instrument further comprises an articulation means connecting the main body and the rear body, where the articulation means allows the rear body to pivot with respect to the main body about an axis of articulation perpendicular to the longitudinal direction, between a loading position in which the access opening lies away from the main body and an unlocked position in which the longitudinal direction and the loading direction substantially coincide.

Thus, changing the cartridge does not entail separating and then reassembling the rear body and the main body, particularly by unscrewing and re-screwing in order to change the cartridge. It is therefore more practical and quicker. Furthermore, as the rear body remains connected to the main body, there is no risk of mislaying it while loading a new cartridge.

According to another feature of embodiments of the present invention, in the unlocked position, the first end of the rear body is positioned between the axis of articulation and the first end of the main body.

Thus, when the writing instrument is brought into the unlocked position by pivoting the articulation means, the access opening is automatically retracted.

According to another feature of embodiments of the present invention, the articulation means allows the rear body to slide in the longitudinal direction between the unlocked position and the position of use.

Thus, in the case of a fountain pen cartridge, by sliding the rear body, the cartridge can be engaged in the main element in order to supply the writing tip with ink and, in the case of a cartridge that incorporates the writing tip (a ballpoint, in particular), the tip is passed through the main body and emerges via the first end.

According to an additional feature of embodiments of the present invention, the articulation means prevents the rear body from pivoting with respect to the main body about the axis of articulation during the sliding in the longitudinal direction between the position of use and the unlocked position.

Thus, the risk of inadvertently pivoting the rear body and the forces exerted on the cartridge that are liable to lead to breakage of the cartridge, or at least to leaks of ink, are reduced.

According to an embodiment of the present invention, the articulation means comprises a rod with two flats sliding between two guide surfaces positioned facing one another to define a slot, the guide surfaces having an indentation designed to accept the rod and allow the rod to pivot with respect to the slot about the axis of articulation when the writing instrument is in the unlocked position, so as to allow the rear body to pivot toward the position for loading the writing instrument.

This solution is simple, inexpensive, robust and reliable.

According to an additional feature of embodiments of the present invention, the indentations allow the rod to pivot with respect to the slot about the axis of articulation only through an angle limited to the position for loading the writing instrument.

As the pivoting movement of the rear body with respect to the main body about the axis of pivoting is limited to the loading position, it is easier to load the cartridge into the housing in the rear body while holding the writing element.

In order to make loading the cartridge into the housing even easier still, according to another feature of embodiments of the present invention, the rod and the indentation have complementary shapes that cooperate with one another in order to hold the rear body in the loading position.

Preferably, the pivot angle about the axis of rotation with respect to the slot between the unlocked position and the loading position ranges between 20° and 50°.

This angle is large enough to load or extract a cartridge and allows the main body and the rear body to be held easily.

According to another feature of embodiments of the present invention, the writing instrument further comprises a cap intended to cover the writing tip, an indexing means for positioning the cap with respect to the main body about the longitudinal direction, and a holding means for retaining the cap by clipping the cap onto the main body thereby preventing the cap from sliding in the longitudinal direction with respect to the main body.

Thus, the cap held on the main body is indexed in terms of rotation with respect to the main body.

According to one embodiment of the present invention, the writing instrument comprises the following features:

an indexing means comprising:

at least one stud formed as a protrusion on the main body and running substantially perpendicular to the longitudinal direction near the first end, and a blind slot having a complementary shape to that of the stud and running between an insertion end and a stop end, and a retaining means comprising a neck formed in the slot near the stop end, the slot defining, near its stop end, a substantially Ω shape so as to releasably attach the stud at the stop end.

According to another embodiment of the present invention, the writing instrument comprises:

an indexing means comprising:

an indexing protrusion running radially flush to the longitudinal direction but protruding in the longitudinal direction, and a blind housing of complementary shape formed in the cap, and a retaining means comprising beading formed on the main body and cooperating, through elastic deformation, with a retaining ring feature formed as a protrusion in the cap.

BRIEF DESCRIPTION OF THE DRAWINGS

The present invention will be better understood from reading the description of embodiments of the present invention that follow with reference to the attached drawings in which:

FIG. 8 illustrates a perspective view of the cap illustrated in FIG. 1;

FIG. 9 is an enlarged partial cross-sectional view taken along line IX-IX in FIG. 1 of the writing instrument with the cap held in place on the main body;

FIG. 11 illustrates a perspective view of the cap illustrated in FIG. 10; and FIG. 12 is an enlarged partial cross-sectional view taken along line XII-XII in FIG. 10 of the writing instrument with the cap held in place on the main body.

DESCRIPTION OF THE INVENTION

Figure 1:
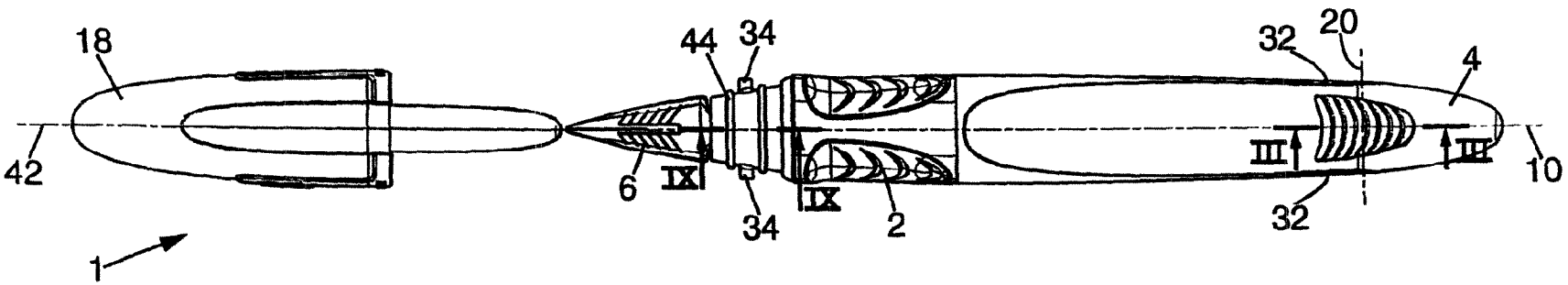
FIG. 1 illustrates a top view of a writing instrument in the position of use, according to an embodiment of the present invention.

FIGS. 1 to 9 illustrate a fountain pen 1 comprising a main body 2 running in a longitudinal direction 10 between a front end 2*a* and a rear end 2*b*, a nib 6 and a duct 7 which are fixed to the main body 2 near its front end 2*a*, a rear body 4 connected to the main body 2 near its rear end 2*b* and a cap 18 intended to protect the nib 6.

The rear body 4 comprises a housing 14 running in a loading direction 12 between a front end 14*a* and a rear end 14*b* of the housing 14. The housing 14 contains an ink cartridge 8 held in position by a tab 40.

Near its rear end 2*b*, the main body 2 comprises two flanges 32 running substantially in the longitudinal direction 10, one on each side of the rear body 4. The flanges 32 are joined together by a rod 22 running across the rear body 4 in the direction of an axis of articulation 20 perpendicular to the longitudinal direction 10 and the loading direction 12. The rod 22 has two flats 24*a*, 24*b* running substantially parallel to one another so that the rod 22 has a substantially rectangular shape in cross section.

The rear body 4 articulates with respect to the main body 2 through a slot 26 in which the rod 22 can move. The slot 26 has two guide surfaces 26*a*, 26*b* running parallel to and on each side of a mid-plane P containing the axis of articulation 20, and parallel to the loading direction 12.

Figure 3:
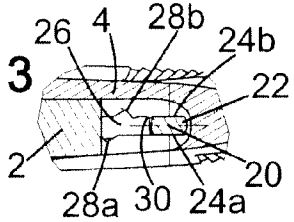
FIG. 3 is a partial cross-sectional view taken along line III-III in FIG. 1 of the writing instrument.
Figure 2:
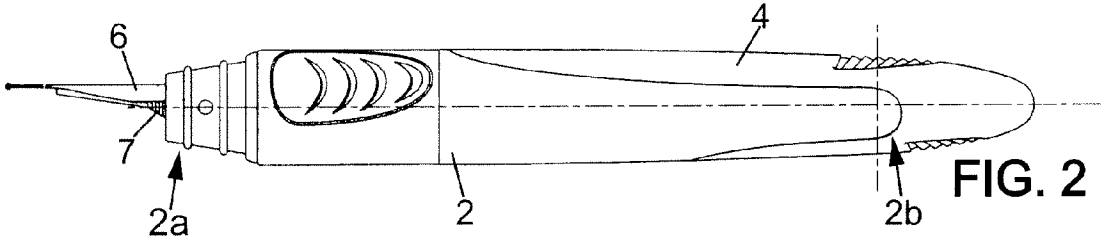
FIG. 2 illustrates a side view of the writing instrument of FIG. 1, without its cap.

In the position of use illustrated in FIGS. 1 to 3, the guide surfaces 26*a*, 26*b* of the slot 26 come into close contact with the flats 24*a*, 24*b* formed on the rod 22 so that the rear body 4 does not move with respect to the main body 2 except in the mid-plane P direction.

The longitudinal direction 10 and the loading direction 12 are therefore substantially coaxial. What is more, the flanges 32 running one on each side of the rear body 4 cooperate with the flat lateral flanks of the rear body 4 to allow the rear body 4 only a translational movement in the longitudinal direction 10 with respect to the main body 2, between the unlocked position and the position of use.

The rear body 4 is held in the position of use by beading defining a boss 30 protruding from the guide surface 26*b*. However, this retention can be overcome by elastic deformation if a force is exerted in the longitudinal direction 10 between the rear body 4 and the main body 2.

The rear body 4 can thus be retreated in the longitudinal distance 10 by a distance d with respect to the main body 2. During this translational movement, the flats 24*a*, 24*b* on the rod 22 move, bearing against the guide surface 26*a* and 26*b* of the slot 26 of the rear body 4. The translational movement in the longitudinal direction 10 is limited by a restriction 48 formed in the slot 26 and against which the rod 22 abuts.

Figure 5:
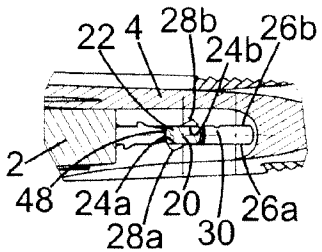
FIG. 5 is a partial cross-sectional view taken along line III-III in FIG. 1 of the writing instrument in the unlocked position.
Figure 7:
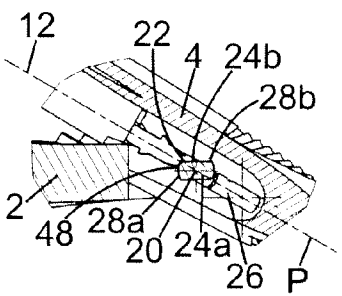
FIG. 7 is a partial cross-sectional view taken along line III-III in FIG. 1 of the writing instrument in the loading position.
Figure 4:
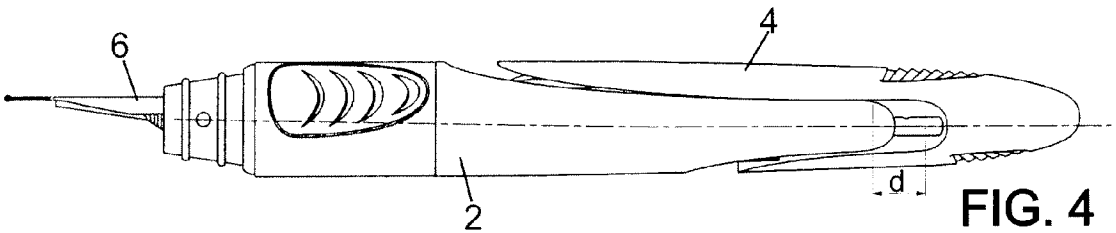
FIG. 4 illustrates the writing instrument according to FIG. 2, in the unlocked position.
Figure 6:
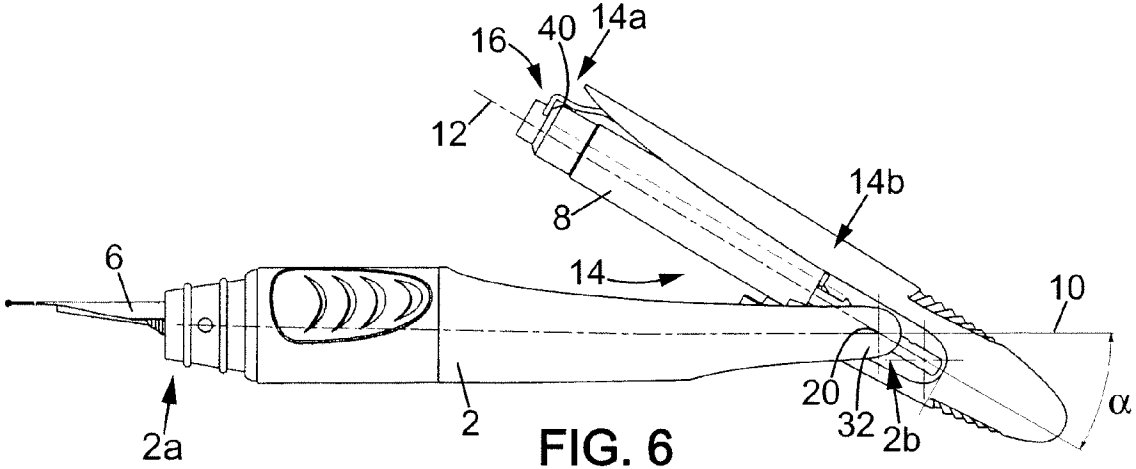
FIG. 6 illustrates the writing instrument according to FIG. 2, in the loading position.

The pen is then in the unlocked position illustrated in FIGS. 4 and 5. The rod 22 is positioned facing indentations 28*a* and 28*b* which define recesses in the guide surfaces 26*a* and 26*b* of the slot 26. The rear body 4 can therefore pivot about the axis of articulation 20 with respect to the main body 2 through an angle $\alpha$ by causing the rod 22 to enter the indentations 28*a* and 28*b* provided in the slot 26 for that purpose. The angle $\alpha$ advantageously ranges between 20° and 50°, so as to uncover the access orifice 16 that extends at the front end 14*a* of the housing 14 thus enabling extraction and replacement of the cartridge 8, engaging the cartridge 8 substantially in the engagement direction 12 and bringing the cartridge 8 to bear against the tab 40 through a slight pivoting about an axis substantially parallel to the axis of articulation 20.

After the new cartridge is in place, the movements are performed in reverse order, pivoting the rear body 4 about the axis of articulation 20 to make the loading direction 12 correspond to the longitudinal axis 10 of the main body 2. The cartridge 8 is then engaged in the main body 2 through a translational movement of the main body 2 in the longitudinal direction 10 toward the front end 2*a* until the pen locks in the position of usevia the boss 30.

Furthermore, near its front end 2*a*, the main body 2 comprises two studs 34 protruding substantially perpendicular to the longitudinal direction 10. The cap 18 has two complementary slots 36 running in an engagement direction 42 substantially corresponding to the longitudinal direction of the cap 18.

The slots 36 run between an insertion end 36*a* and a stop end 36*b*. Near the stop end 36*b*, the slot 36 narrows forming a neck 38 so that, near its stop end 36*b*, the slot 36 has a substantially Ω shape intended to hold the cap 18 in place in the closed position. In this position, the cap 18 is held on the main body 2 near the front end 2*a* by means of the neck 38 which releasably holds the studs 34 at the stop end 36*b* of the slot 36. An O-ring 44 held on the main body 2 is compressed against the cap 18 to improve the seal between the cap 18 and the main body 2.

Figure 10:
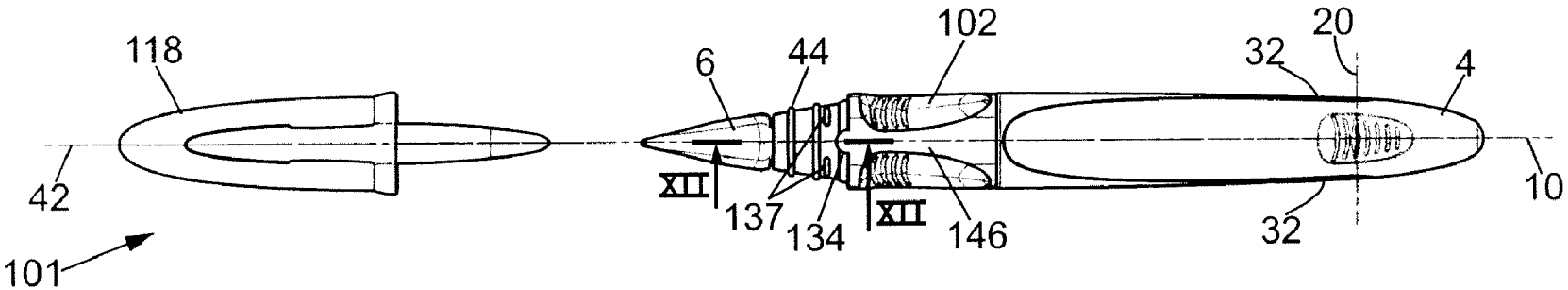
FIG. 10 illustrates a top view of a writing instrument, according to an embodiment of the present invention.

Another embodiment of the present invention illustrated in FIGS. 10 to 12 essentially differs from the embodiment illustrated in FIGS. 1 to 9 in that the studs 34 and the cap 18 have been replaced by an indexing (mistake-proofing) element 134 and beading 137 that are formed on the main body 102 and the cap 118, respectively.

In FIGS. 10 to 12, elements that are unchanged from FIGS. 1 to 9 have the identical reference numerals and elements that correspond to those of FIGS. 10 to 12 have a reference numeral increased by 100.

The indexing element 134 runs in the continuation of the substantially cylindrical exterior surface 146 of the main body 102, with which it is flush radially to the direction of elongation and protrudes in the longitudinal direction 10.

The cap 118 internally has a blind housing 136 of a shape that complements that of the indexing element 134 running in the direction of engagement 42 of the cap 118. The cap 118 further comprises a retaining ring feature 138 consisting of three portions internally protruding into the cap 118 and engaging, by elastic deformation, with the beading 137, which itself consists of three corresponding portions.

The cap 118 is clipped on to the main body 102 by a translational movement along axis 42 in the longitudinal direction 10, engaging the indexing element 134 in the housing 136 and overlapping the portions of the retaining ring feature 138 with the portions of beading 137.

Of course, the embodiments of the present invention just described are merely one nonlimiting examples of the present invention. Thus, it is possible to conceive of using a pen with a refillable cartridge, a ballpoint or a felt-tip instead of a fountain pen. The conversion is effected by substituting a writing tip of the ball-point type or felt-tip type and a suitable duct for the nib 6 and the duct 7.

The invention claimed is:

1. A writing instrument comprising:

a main body comprising a first end and a second end and having a longitudinal axis extending in a longitudinal direction through the first and second ends;

a writing tip disposed at the first end of the main body;

an ink-containing cartridge;

a rear body comprising an elongate housing having a first end a second end and an access opening at the first end allowing the ink-containing cartridge to be inserted into or removed from the housing, the housing extending in a loading direction between the first and second ends of the elongate housing; and an articulation means connecting the main body and the rear body;

wherein the articulation means allows the rear body with the ink-containing cartridge inserted in the housing to pivot with respect to the main body about an axis of articulation perpendicular to the longitudinal axis, between a loading or open position in which the access opening is rotated away from the longitudinal axis of the main body and a closed position in which the longitudinal direction and the loading direction substantially coincide, and wherein the closed position is the position of use of the writing instrument where the ink-containing cartridge is engaged with the main body.

2. The writing instrument as claimed in claim 1, wherein, in the closed position, the first end of the rear body is positioned substantially in line with the axis of articulation and the first end of the main body.

3. The writing instrument as claimed in claim 1, wherein the articulation means allows the rear body to slide in the longitudinal direction between the loading or open position and the closed position.

4. The writing instrument as claimed in claim 3, wherein the articulation means prevents the rear body from pivoting with respect to the main body about the axis of articulation during sliding in the longitudinal direction between a locked position and an unlocked position.

5. The writing instrument as claimed in claim 4, wherein the articulation means comprises:

a rod comprising two parallel flat portions; and a slot in the rear body, the slot comprising two guide surfaces facing one another;

wherein the guide surfaces include indentations designed to accept the rod and allow the rod to pivot with respect to the slot about the axis of articulation when the writing instrument is in the unlocked position, so as to allow the rear body to pivot away from the longitudinal axis of the main body towards the loading position of the writing instrument.

6. The writing instrument as claimed in claim 5, wherein the indentations allow the rod to pivot with respect to the slot about the axis of articulation through an angle $\alpha$ to the loading position of the writing instrument.

7. The writing instrument as claimed in claim 6, wherein angle $\alpha$ ranges between 20° and 50°.

8. The writing instrument as claimed in claim 6, wherein the rod and the indentations have complementary shapes that cooperate with one another in order to hold the rear body in the loading position of the writing instrument.

9. The writing instrument as claimed in claim 5, wherein the slot further comprises a boss that cooperates with the rod to hold the rear body in the locked position with respect to the main body.

10. The writing instrument as claimed in claim 5, wherein the main body further comprises, near the second end, two flanges running substantially perpendicular to the direction of articulation and between which the rod extends.

11. The writing instrument as claimed in claim 1, further comprising a cap to cover the writing tip, the cap having an indexing means for positioning the cap with respect to the main body about the longitudinal axis and a retaining means for holding the cap onto the main body in the longitudinal direction by clipping.

12. The writing instrument as claimed in claim 11, wherein the indexing means comprises:

at least one stud formed as a protrusion at the front end of the main body and running substantially perpendicular to the longitudinal axis; and a blind slot having a complementary shape to that of the at least one stud and running between an insertion end and a stop end of the cap.

13. The writing instrument as claimed in claim 12, wherein the retaining means comprises a neck formed in the blind slot near the stop end of the cap, said slot defining, near its stop end, a substantially Ω shape so as to releasably lock the stud at the stop end.

14. The writing instrument as claimed in claim 11, wherein the indexing means comprises:

an indexing protrusion extending in the longitudinal direction; and a housing formed in the cap, having a complementary shape to that of the indexing protrusion.

15. The writing instrument as claimed in claim 14, wherein the retaining means comprises beading formed on the main body that cooperates, through elastic deformation, with a retaining ring feature formed as a protrusion in the cap.

16. A writing instrument comprising:

a main body portion comprising a front end and a rear end and having a longitudinal axis extending in a longitudinal direction from the front end to the rear end;

a rear body portion comprising an elongate housing having a front end and a rear end, the rear body portion being pivotable with respect to the main body portion about a pivot axis substantially perpendicular to the longitudinal axis of the main body portion;

a pivot means connecting the main body portion and the rear body portion; and an ink-containing cartridge;

wherein the pivot means allows the rear body portion with the ink-containing cartridge inserted in the housing to rotate with respect to the main body portion about the pivot axis, between a closed position in which the front end of the rear body portion substantially aligns with the longitudinal axis of the main body portion and a loading position in which the front end of the rear body portion is rotated in a direction away from the longitudinal axis of the main body portion, and wherein the closed position is the position of use of the writing instrument where the ink-cartridge is engaged with the main body.

17. The writing instrument as claimed in claim 16 further comprising a writing tip disposed at the front end of the main body portion and a writing medium cartridge removably disposed within the elongate housing of the rear body portion.

18. A method of replacing and ink cartridge in a writing instrument comprising the steps of:

providing a writing instrument comprising:

a main body portion comprising a front end and a rear end and having a longitudinal axis extending in a longitudinal direction from the front end to the rear end;

rear body portion comprising an elongate housing having a front end and a rear end and housing the ink cartridge, the rear body portion being pivotable with respect to the main body portion about a pivot axis substantially perpendicular to the longitudinal axis of the main body portion; and a pivot means connecting the main body portion and the rear body portion;

wherein the pivot means allows the rear body portion to rotate with respect to the main body portion about the pivot axis, between a closed position in which the front end of the rear body portion substantially aligns with the longitudinal axis of the main body portion and a loading position in which the front end of the rear body portion is rotated in a direction away from the longitudinal axis of the main body portion;

unlocking the writing instrument by displacing the rear body portion with respect to the main body portion in the longitudinal direction away from the main body portion;

pivoting or rotating the rear body portion with respect to the main body portion about the pivot axis in a direction away from the longitudinal axis of the main body portion so as to expose the front end of the elongate housing;

removing the existing ink cartridge from the elongate housing;

inserting a new ink cartridge into the elongate housing;

pivoting or rotating the rear body portion with respect to the main body portion about the pivot axis in a direction toward the longitudinal axis of the main body portion so as to substantially align the front end of the rear body portion with the front end of the main body portion; and locking the writing instrument by displacing the rear body portion with respect to the main body portion in the longitudinal direction towards the front end of the main body portion.

19. A writing instrument comprising:

a main body comprising a first end and a second end and having a longitudinal axis extending in a longitudinal direction through the first and second ends;

a writing tip disposed at the first end of the main body;

an ink-containing cartridge;

a rear body comprising an elongate housing having a first end a second end and an access opening at the first end allowing the ink-containing cartridge to be inserted into or removed from the housing, the housing extending in a loading direction between the first and second ends of the elongate housing; and an articulation means connecting the main body and the rear body, the articulation means allows the rear body to pivot with respect to the main body about an axis of articulation perpendicular to the longitudinal axis, between a loading or open position in which the access opening is rotated away from the longitudinal axis of the main body and a closed position in which the longitudinal direction and the loading direction substantially coincide;

wherein the articulation means allows the rear body to slide in the longitudinal direction between the loading or open position and the closed position.

* * * * *